US006941664B1

(12) United States Patent
Engle et al.

(10) Patent No.: US 6,941,664 B1
(45) Date of Patent: Sep. 13, 2005

(54) SHINGLE CUTTING TOOL

(76) Inventors: Tony Engle, 10971 Sweet Potato Ridge, Brookville, OH (US) 45309; Michael D. Engle, 10971 Sweet Potato Ridge, Brookville, OH (US) 45309

( * ) Notice: Subject to any disclaimer, the term of this patent is extended or adjusted under 35 U.S.C. 154(b) by 11 days.

(21) Appl. No.: 10/351,657

(22) Filed: Jan. 28, 2003

(51) Int. Cl.[7] ..... B26B 29/00; B26B 3/00

(52) U.S. Cl. ..... 30/286; 30/287; 30/294; 30/299; 30/312; 30/314; 30/317

(58) Field of Search ..... 30/286, 287, 289, 30/294, 299, 312, 314, 317, 293, 278, 279.2, 30/280, 283, 315, DIG. 3; 83/920; D8/98–104

(56) References Cited

U.S. PATENT DOCUMENTS

| | | | | | |
|---|---|---|---|---|---|
| 1,951,452 | A | * | 3/1934 | Stevens | 30/478 |
| 2,233,497 | A | * | 3/1941 | Teigen | 30/DIG. 3 |
| 2,238,678 | A | * | 4/1941 | Cook | 30/294 |
| 2,649,656 | A | * | 8/1953 | Hedrick | 30/DIG. 30 |
| 2,726,448 | A | * | 12/1955 | Smith | 30/286 |
| 3,543,400 | A | * | 12/1970 | Scott et al. | 30/294 |
| 3,678,581 | A | * | 7/1972 | Bolduc | 30/294 |
| 3,821,849 | A | * | 7/1974 | Grinnon | 30/2 |
| 3,934,342 | A | * | 1/1976 | Matsushita | 30/293 |
| 4,064,627 | A | * | 12/1977 | Zanfini | 30/287 |
| 4,148,142 | A | * | 4/1979 | Sullivan et al. | 30/293 |
| D256,883 | S | * | 9/1980 | Wharmby | D8/98 |
| 4,262,418 | A | * | 4/1981 | Hill et al. | 30/287 |
| 4,286,384 | A | * | 9/1981 | Kotchy | 30/287 |
| 4,648,181 | A | * | 3/1987 | Fortin | 30/293 |
| 4,821,609 | A | | 4/1989 | Rushbrook et al. | |
| D312,197 | S | | 11/1990 | Gordon | |
| 4,977,673 | A | * | 12/1990 | Altizer | 30/294 |
| 5,044,081 | A | * | 9/1991 | Nguyen | 30/294 |
| 5,052,256 | A | | 10/1991 | Morrissey | |
| 5,127,161 | A | * | 7/1992 | Ikeda | 30/294 |
| 5,353,508 | A | * | 10/1994 | Baker | 33/42 |
| 5,392,677 | A | | 2/1995 | Sevart et al. | |
| 5,638,603 | A | * | 6/1997 | Li | 30/294 |
| 5,644,963 | A | | 7/1997 | Fountas | |
| 5,715,605 | A | * | 2/1998 | Nadeau | 30/293 |
| 5,881,463 | A | * | 3/1999 | Casteel et al. | 30/314 |
| 5,946,808 | A | * | 9/1999 | Martinez | 30/290 |
| 5,996,461 | A | | 12/1999 | Croft | |
| 6,079,304 | A | * | 6/2000 | Bisceglia | 83/51 |
| 6,745,476 | B2 | * | 6/2004 | Korba, Jr. | 30/294 |
| 6,807,737 | B1 | * | 10/2004 | Davia | 30/294 |

* cited by examiner

*Primary Examiner*—Allan N. Shoap
*Assistant Examiner*—Jason Prone

(57) ABSTRACT

A shingle cutting tool for trimming shingles includes a vertical panel having a front edge, a back edge, a bottom edge and a top edge. A horizontal slot for receiving shingles extends into the front edge and extends toward the back edge. A front handle is attached to the vertical panel and is positioned nearer the front edge than the back edge. A plurality of cutting members is attached to the vertical panel and each extends into a plane of the slot. The cutting members include a cutting edge directed generally toward the front edge. A horizontal panel is attached to and extends away from either side of the vertical panel. The shingles are inserted into the slot and the front edge pulled forward such that the cutting members cut the shingles.

13 Claims, 5 Drawing Sheets

SHINGLE CUTTING TOOL

BACKGROUND OF THE INVENTION

1. Field of the Invention

The present invention relates to shingle cutting tools and more particularly pertains to a new shingle cutting tool that would be used trim sections of shingles hanging over the edge of a roof after installation.

2. Description of the Prior Art

The use of shingle cutting tools is known in the prior art. U.S. Pat. No. 4,821,609 describes a shingle cutting tool for cutting portions of shingles from an existing shingled roof. Another type of shingle cutting tool is U.S. Pat. No. 5,644,963 having a roofing shingle cutting guide that may be fixed at non-perpendicular and perpendicular angles to the long axis of the base plate. U.S. Pat. No. 5,052,256 describes an apparatus for cutting shingles including a base, a lever arm pivotally mounted to the base, and a pair of diverging cutting blades mounted to the lever arm. U.S. Pat. No. 5,996,461 describes an asphalt shingle sheet cutting device for quickly cutting an asphalt shingle sheet along a straight line at a variety of angles. U.S. Pat. No. 5,392,677 describes a roofing shingle angle cutter tool for cutting a shingle for making cuts across the shingle at a selectable angle transverse to the longitudinal edge. U.S. Pat. No. Des. 312,197 describes an ornamental design for a roofing shingle stripper.

While these devices fulfill their respective, particular objectives and requirements, the need remains for a device that is superior for cutting shingles hanging over the edge of a roof.

SUMMARY OF THE INVENTION

The present invention meets the needs presented above by a lower portion of a vertical panel that forms a guide to be used along the edge of the roof. The cutting is done along a straight line that is parallel with the edge of the roof.

Another object of the present invention is to provide a new shingle cutting tool that would be easy to use and reduce the time and manpower required to trim shingles from the edge of the roof.

Still another object of the present invention is to provide a new shingle cutting tool that would create a neat and uniform appearance.

To this end, the present invention generally comprises a vertical panel having a front edge, a back edge, a bottom edge and a top edge. A horizontal slot for receiving shingles extends into the front edge and extends toward the back edge. A front handle is attached to the vertical panel and is positioned nearer the front edge than the back edge. A plurality of cutting members is attached to the vertical panel and each extends into a plane of the slot. The cutting members include a cutting edge directed generally toward the front edge. A horizontal panel is attached to and extends away from either side of the vertical panel. The shingles are inserted into the slot and the front edge pulled forward such that the cutting members cut the shingles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
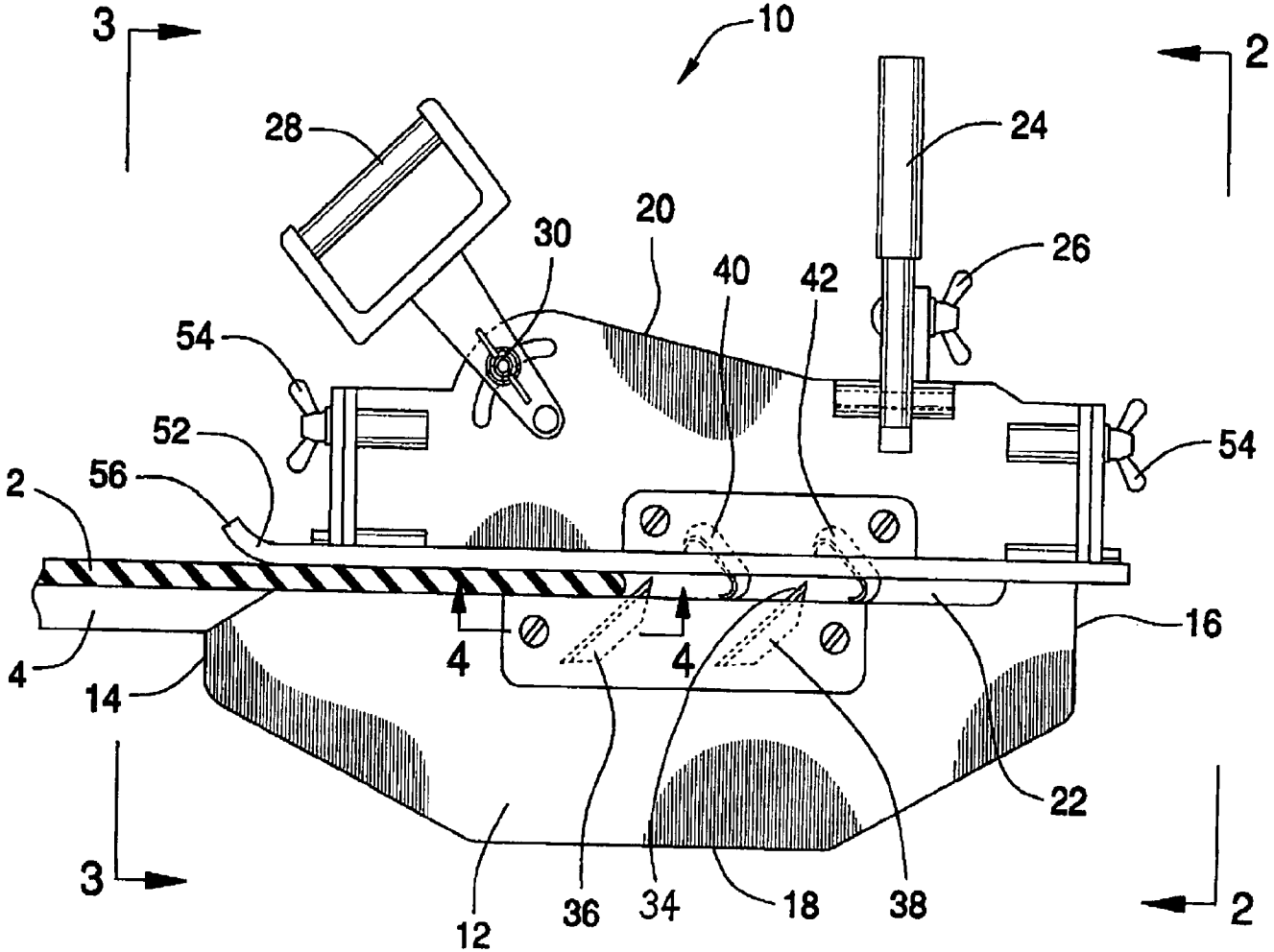
FIG. 1 is a top in-use view of a shingle cutting tool according to the present invention.
Figure 2:
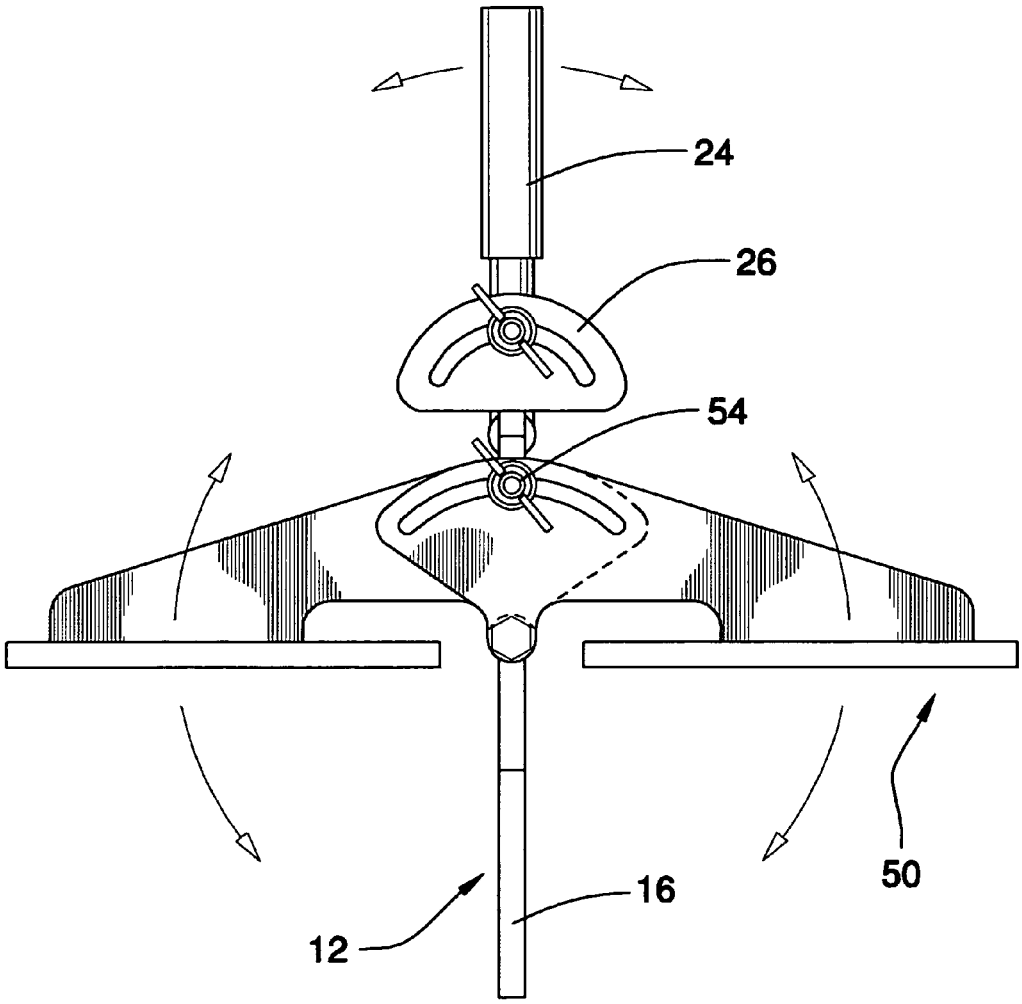
FIG. 2 is a side view of the present invention.
Figure 3:
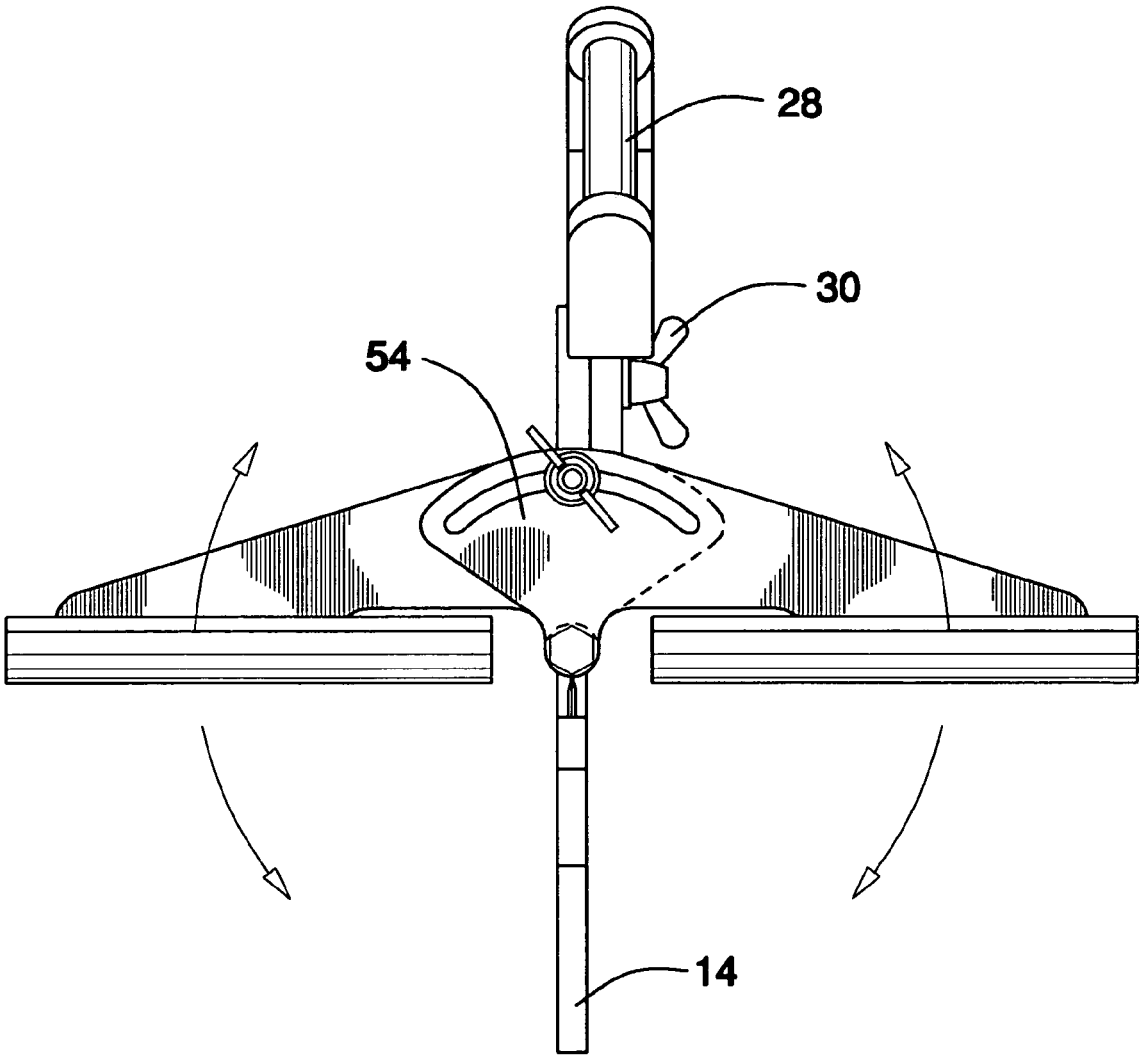
FIG. 3 is a bottom view of the present invention.
Figure 4:
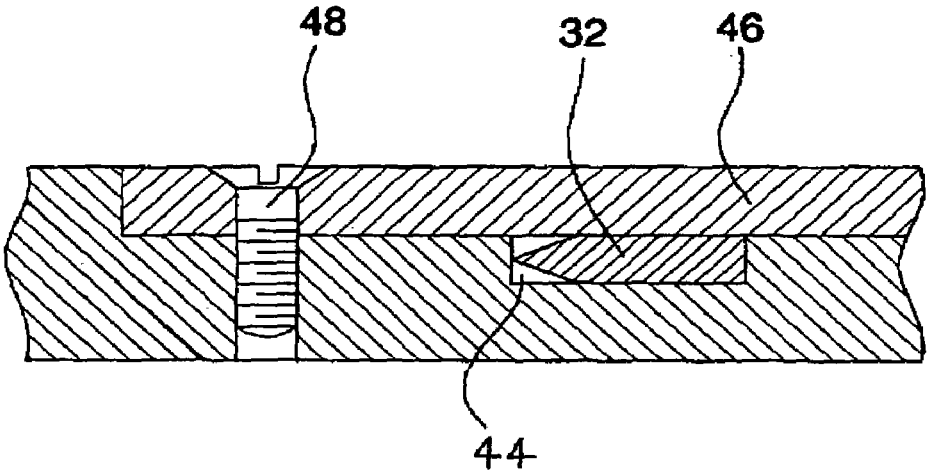
FIG. 4 is a side view of the present invention.
Figure 5:
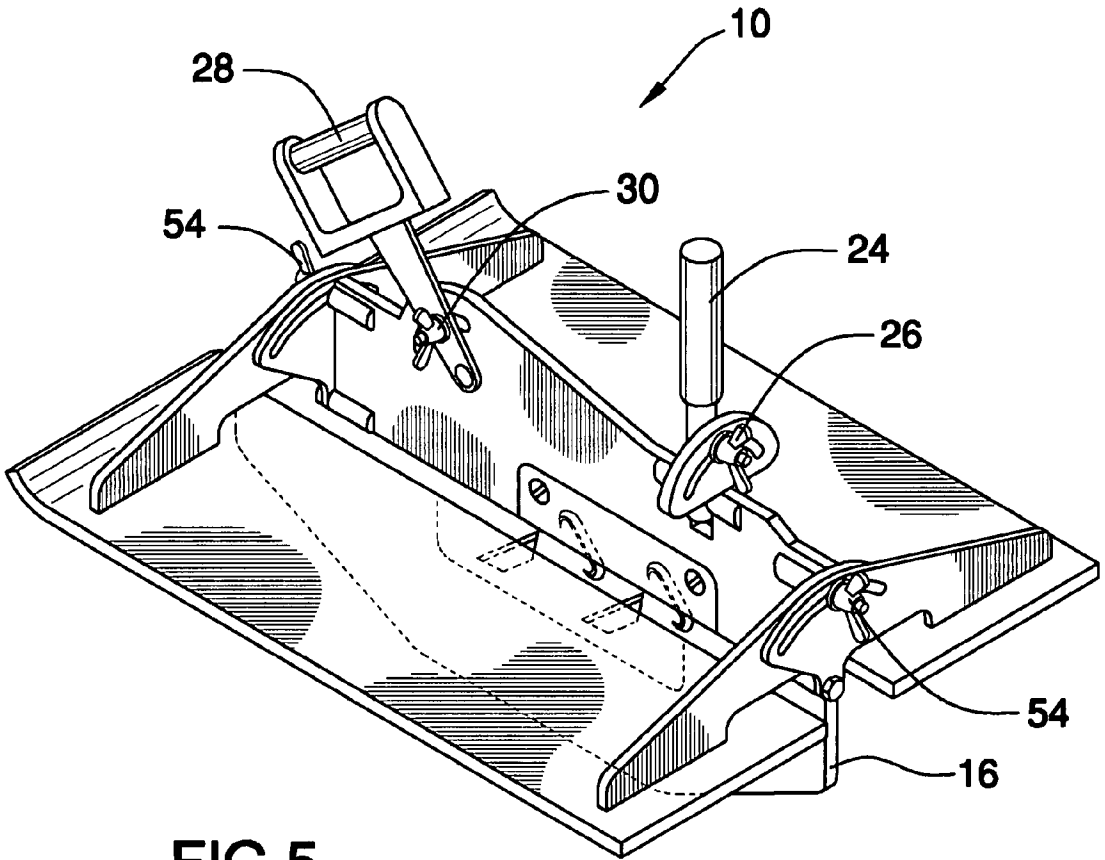
FIG. 5 is an end view of the present invention.

With reference now to the drawings, and in particular to FIGS. 1 through 5 thereof, a new shingle cutting tool embodying the principles and concepts of the present invention and generally designated by the reference numeral 10 will be described.

As best illustrated in FIGS. 1 through 5, the shingle cutting tool 10 generally comprises a tool 10 for cutting shingles 2 along a straight line to remove excess shingles 2 along the edge of a roof after the shingles are attached to the roof 4. The tool 10 includes a vertical panel 12 having a front edge 14, a back edge 16, a bottom edge 18 and a top edge 20. A horizontal slot 22 for receiving shingles 2 extends into the front edge 14 and extends toward the back edge 16. The slot 22 is positioned generally between the top 20 and bottom 18 edges.

A rear handle 24 is attached to the vertical panel 12 and is positioned nearer the back edge 16 than the front edge 14. The rear handle 24 extends upwardly from the vertical panel 12. The rear handle 24 is adapted for selectively pivoting in a plane orientated perpendicular to a plane of the vertical panel 12. A locking member 26 is mechanically coupled to the vertical panel 12 and the rear handle 24 for selectively locking the rear handle 24 with respect to the vertical panel 12.

A front handle 28 is attached to the vertical panel 12 and is positioned adjacent to the top edge 20. The front handle 28 is positioned nearer the front edge 14 than the back edge 16. The front handle 28 is adapted for selectively pivoting in a plane orientated parallel to the plane of the vertical panel 12. A securing member 30 extends through the front handle 28 and the vertical panel 12 for selectively locking the front handle 28 with respect to the vertical panel 12.

A plurality of cutting members 32 is attached to the vertical panel 12 and extends into a plane of the slot 22. Each of the cutting members 32 includes a cutting edge 34 directed generally toward the front edge 14. A first of the cutting members 36 is attached to the vertical panel 12 between the top edge 20 and the slot 22 and extends upward into the plane of the slot 22. A second of the cutting members 38 is attached to the vertical panel 12 between the bottom edge 18 and the slot 22 and extends upward into the plane of the slot 22. A third of the cutting members 40 is attached to the vertical panel 12 between the top edge 20 and the slot 22 and comprises a curved blade. A fourth of the cutting members 42 is attached to the vertical panel 12 between the top edge 20 and the slot 22 and comprises a curved blade. The cutting members 32 are preferably positioned in a depression 44 in the vertical panel 12 and are secured therein by a plate 46 and at least one fastener 48.

A horizontal panel 50 is attached to and extends away from either side of the vertical panel 12. The horizontal panel 50 is positioned generally adjacent to the slot 22 and between the slot 22 and the bottom edge. The horizontal panel 50 is divided into a pair of side panels 52. Each of the side panels 52 is positioned on opposite sides of the vertical panel 12. The side panels 52 are each pivotally coupled to the vertical panel 12 such that each of the side panels 52 may be independently pivoted. Each of a pair of fastening members 54 is mechanically coupled to one of the side panels 52 for selectively locking the side panels 52 with respect to the vertical panel 12. The side panels 52 each have a forward end 56 that is arcuate and extends upwardly out of a horizontal plane of the side panels 52.

In use, the shingles 2 are inserted into the slot 22 while the vertical panel 12 abuts an edge of the roof 4. The front edge 14 of the tool 10 is pulled forward. This process is aided by the handles, and in particular the front handle 28 which, because it is formed by an opening, is particularly useful for a pulling motion. As the shingles 2 are brought through the slot 22, the cutting members 32 cut the shingles 2. Because a lower portion of the vertical panel 12 forms a guide to be used along the edge of the roof 4, the cutting is done along a straight line that is parallel with the edge of the roof 4.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tool for cutting shingles along a straight line comprising:

a vertical panel having a front edge, a back edge, a bottom edge and a top edge, a horizontal slot for receiving shingles extending into said front edge and extending toward said back edge, a rear handle being attached to said vertical panel;

a plurality of cutting members being attached to said vertical panel and extending into a plane of the slot, each of said cutting members including a cutting edge directed generally toward said front edge;

a horizontal panel being attached to and extending away from either side of said vertical panel, said horizontal panel being divided into a pair of side panels, each of said side panels being positioned on opposite sides of said vertical panel, each of said side panels being pivotally coupled to said vertical panel such that each of said side panels may be independently pivoted; and wherein the shingles are inserted into said slot and said front edge pulled forward such that said cutting members cut the shingles.

2. The tool for cutting shingles of claim 1, each of a pair of fastening members being mechanically coupled to one of said side panels for selectively locking said side panels with respect to said vertical panel.

3. The tool for cutting shingles of claim 1, wherein at least one of said cutting members comprises a curved blade.

4. The tool for cutting shingles of claim 1, wherein said rear handle is positioned nearer said back edge than said front edge, said rear handle extending upwardly from said vertical panel, said rear handle being adapted for selectively pivoting in a plane orientated perpendicular to a plane of said vertical panel.

5. The tool for cutting shingles of claim 4, further including a locking member being mechanically coupled to said vertical panel and said rear handle for selectively locking said rear handle with respect to said vertical panel.

6. The tool for cutting shingles of claim 5, further including a front handle being attached to said vertical panel and being positioned adjacent to said top edge, said front handle being positioned nearer said front edge than said back edge.

7. The tool for cutting shingles of claim 6, wherein said front handle is adapted for selectively pivoting in a plane orientated parallel to said plane of said vertical panel.

8. The tool for cutting shingles of claim 7, further including a securing member extending through said front handle and said vertical panel for selectively locking said front handle with respect to said vertical panel.

9. The tool for cutting shingles of claim 1, wherein said rear handle is positioned nearer said back edge than said front edge, said rear handle extending upwardly from said vertical panel, a front handle being attached to said vertical panel and being positioned adjacent to said top edge, said front handle being positioned nearer said front edge than said back edge.

10. The tool for cutting shingles of claim 9, wherein at least one of said cutting members comprises a curved blade.

11. The tool for cutting shingles of claim 9, wherein said front handle is adapted for selectively pivoting in a plane orientated parallel to said plane of said vertical panel.

12. The tool for cutting shingles of claim 11, further including a securing member extending through said front handle and said vertical panel for selectively locking said front handle with respect to said vertical panel.

13. A tool for cutting shingles along a straight line comprising:

a vertical panel having a front edge, a back edge, a bottom edge and a top edge, a horizontal slot for receiving shingles extending into said front edge and extending toward said back edge, said slot being positioned generally between said top and bottom edges, a rear handle being attached to said vertical panel and being positioned nearer said back edge than said front edge, said rear handle extending upwardly from said vertical panel, said rear handle being adapted for selectively pivoting in a plane orientated perpendicular to a plane of said vertical panel, a locking member being mechanically coupled to said vertical panel and said rear handle for selectively locking said rear handle with respect to said vertical panel, a front handle being attached to said vertical panel and being positioned adjacent to said top edge, said front handle being positioned nearer said front edge than said back edge, said front handle being adapted for selectively pivoting in a plane orientated parallel to said plane of said vertical panel, a securing member extending through said front handle and said vertical panel for selectively locking said front handle with respect to said vertical panel;

a plurality of cutting members being attached to said vertical panel and extending into a plane of the slot, each of said cutting members including a cutting edge directed generally toward said front edge, a first of said cutting members extending upward into said plane of said slot, a second of said cutting members extending upward into said plane of said slot, a third of said cutting members extending downward into said plane of said slot and comprising a curved blade, a fourth of said cutting members extending downward into said plane of said slot and comprising a curved blade;

a horizontal panel being attached to and extending away from either side of said vertical panel, said horizontal panel being positioned generally adjacent to said slot, said horizontal panel being divided into a pair of side panels, each of said side panels being positioned on opposite sides of said vertical panel, each of said side panels being pivotally coupled to said vertical panel such that each of said side panels may be independently pivoted, each of a pair of fastening members being mechanically coupled to one of said side panels for selectively locking said side panels with respect to said vertical panel, each of said side panels having a forward end being arcuate and extending upwardly out of a horizontal plane of said side panels; and wherein the shingles are inserted into said slot and said front edge pulled forward such that said cutting members cut the shingles.

* * * * *